US005326098A

United States Patent [19]

Ou et al.

[11] Patent Number: 5,326,098

[45] Date of Patent: Jul. 5, 1994

[54] BADMINTON RACKET

[76] Inventors: Li-Min Ou; Chien-Der Lin, both of No. 1-3, Lane 251, Tong-Yeang Rd., Feng-Yuan, Taichung, Taiwan

[21] Appl. No.: 165,116

[22] Filed: Dec. 10, 1993

[51] Int. Cl.[5] ..... A63B 49/08

[52] U.S. Cl. ..... 273/73 R; 273/75; 273/73 J

[58] Field of Search ..... 273/73 R, 73 C, 73 J, 273/75, 67 R

[56] References Cited

U.S. PATENT DOCUMENTS

| | | | |
|---|---|---|---|
| 2,969,984 | 1/1961 | Presnick | 273/73 R |
| 4,033,583 | 7/1977 | Ehrhart | 273/73 R |
| 4,609,198 | 9/1986 | Tarr | 273/73 J |
| 4,693,475 | 9/1987 | Keilhau | 273/73 J |
| 5,092,594 | 3/1992 | Jang | 273/73 R |

FOREIGN PATENT DOCUMENTS

| | | | |
|---|---|---|---|
| 2540388 | 8/1984 | France | 273/73 J |
| 2035099 | 6/1980 | United Kingdom | 273/73 J |
| 2188848 | 10/1987 | United Kingdom | 273/73 R |

*Primary Examiner*—Jessica J. Harrison
*Assistant Examiner*—Raleigh W. Chiu
*Attorney, Agent, or Firm*—Browdy and Neimark

[57] ABSTRACT

A badminton racket comprises a head, a shaft, and a hand grip. The hand grip is provided axially with a receiving hole of an appropriate depth for fastening the shaft with the hand grip. The receiving hole is provided at the bottom thereof with a conical portion becoming gradually smaller in dimension toward the upper end thereof from the lower end thereof. The hand grip is further provided axially with an elongate through hole extending from the upper end of the conical portion through the lower end wall of the hand grip. The adhesive coated on the inner wall of the receiving hole of the hand grip can not be therefore forced out by the shaft being inserted into the receiving hole of the hand grip during the process of fastening the shaft and the hand grip together.

1 Claim, 3 Drawing Sheets

BADMINTON RACKET

BACKGROUND OF THE INVENTION

The present invention relates generally to a badminton racket, and more particularly to the improved shaft and hand grip of the badminton racket.

As shown in FIGS. 1 and 2, a badminton racket 10 of the prior art comprises a head 11, a shaft 12 and a hand grip 13. The head 11 is provided with a strung surface for hitting a shuttlecock. The shaft 12 is fastened at the upper end thereof with the lower end of the head 11. The shaft 12 has a lower end that is fastened with a receiving hole 131 disposed axially in the hand grip 13.

The shortcomings inherent in the prior art badminton racket 10 described above are described hereinafter.

In the process of fastening the shaft 12 with the hand grip 13, the inner wall surface of the receiving hole 131 of the hand grip 13 is first coated with an adhesive, such as a heavy duty glue, the shaft hole 131 in the direction indicated by an arrow 14 as shown in FIG. 1. The shaft 12 has an outer diameter which is only slightly smaller than the diameter of the receiving hole 131. As a result, some of the coated adhesive in the receiving hole 131 of the hand grip 13 is often forced out of the receiving hole 131 by the air pressure in the midst of the process of inserting the shaft 12 into the receiving hole 131 of the hand grip 13. An additional work is called for to clean up the messy hand grip 13. In addition, such a prior art method of fastening the shaft 12 and the hand grip 13 can only be characterized as inefficient in view of the fact that the method is time consuming and that some of the coated adhesive in the receiving hole 131 is squeezed out, thereby undermining the fastening effect.

SUMMARY OF THE INVENTION

It is, therefore, the primary objective of the present invention to provide a badminton racket with a shaft and a hand grip, which are fastened together in such a way that the adhesive coated on the inner wall of the receiving hole of the hand grip is not squeezed out at the time when the process of inserting the shaft into the receiving hole of the hand grip is under way. As a result, the fastening effect of the coated adhesive in the receiving hole of the hand grip is not undermined.

In keeping with the principle of the present invention, the foregoing objective of the present invention is achieved by a badminton racket comprising a head, a shaft and a hand grip. The hand grip is provided axially with a receiving hole of an appropriate depth for fastening the hand grip and the shaft. The receiving hole is provided at the bottom thereof with a conical portion becoming gradually smaller in dimension toward the top thereof from the bottom thereof. The hand grip is further provided axially with an elongate through hole extending form the top of the conical portion through the bottom wall of the hand grip. The adhesive coated on the inner wall of the receiving hole of the hand grip can not be therefore squeezed out by the shaft being inserted into the receiving hole of the hand grip.

DETAILED DESCRIPTION OF THE INVENTION

Figure 1:
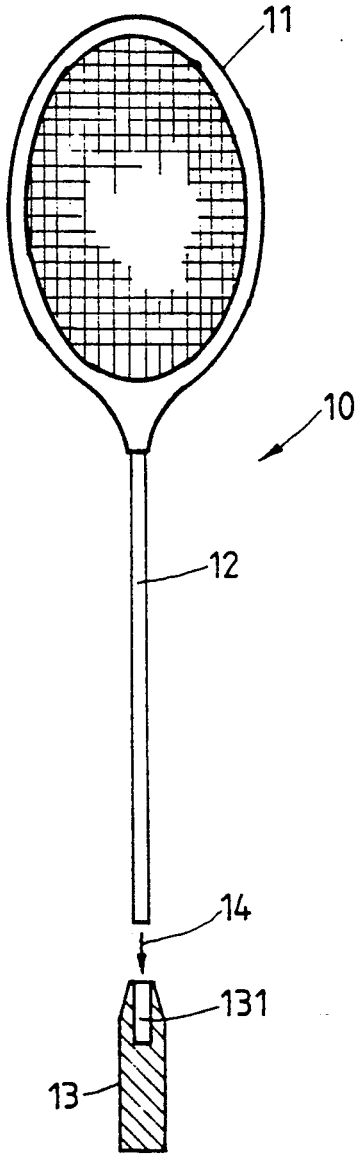
FIG.1 (PRIOR ART)
FIG. 1 shows a partial exploded view of a badminton racket of the prior art.
Figure 2:
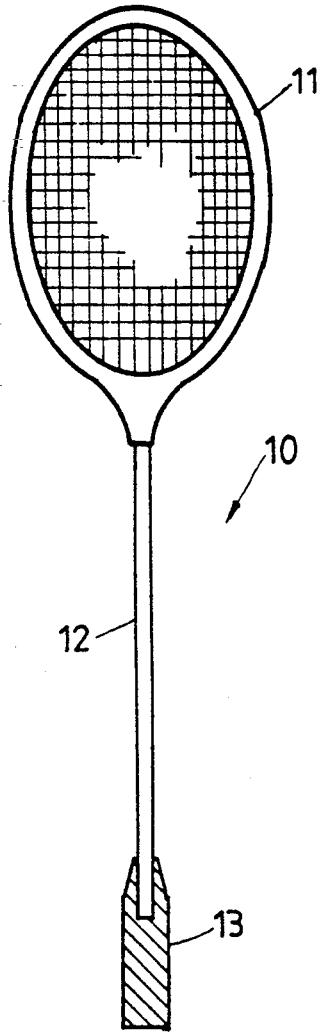
FIG.2 (PRIOR ART)
FIG. 2 shows a schematic view of the badminton racket in combination, according to the prior art.
Figure 3:
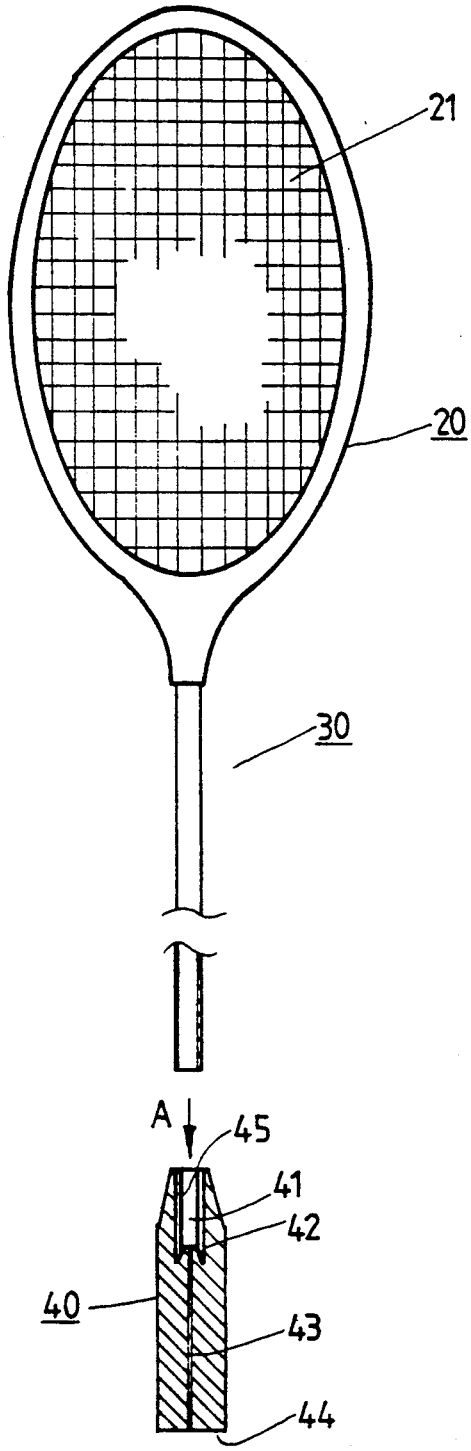
FIG. 3 shows an exploded view of a badminton racket of the present invention.
Figure 4:
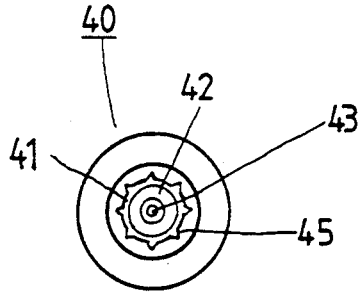
FIG. 4 shows a plan view of a hand grip taken in the direcetion of A as shown in FIG. 3.

Referring to FIGS. 3 and 4, a badminton racket of the present invention is shown to comprise a head 20, a shaft 30, and a hand grip 40.

The head 20 has a strung surface 21 for hitting the shuttlecock. The shaft 30 of aluminium has an upper end that is fastened to the lower end of the head 20. The hand grip 40 is made of a material having an appropriate elasticity. The hand grip 40 embodied in the present invention is made of a plastic material. The hand grip 40 is provided axially with a receiving hole 41 extending from the upper end thereof. The receiving hole 41 of a predetermined depth is provided on the bottom wall thereof with a conical portion 42. The hand grip 40 is further provided axially with an elongate through hole 43 extending from the upper end of the conical portion 42 through the lower end wall 44 of the hand grip 40. The receiving hole 41 is provided axially on the inner wall thereof with a plurality of recessed strips 45 spaced at a predetermined interval.

Figure 5:
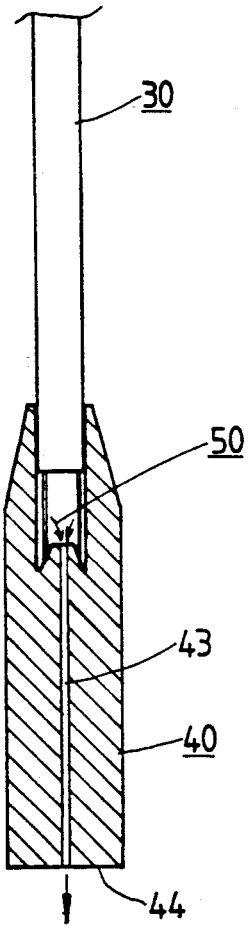
FIG. 5 shows a schematic view of the process of fastening the hand grip and the shaft of the badmintion racket of the present invention.
Figure 6:
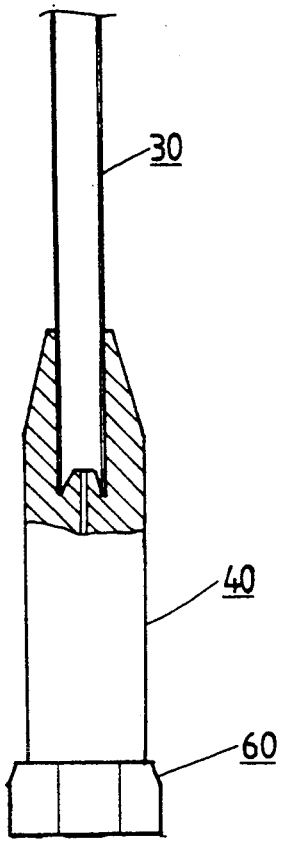
FIG. 6 is a schematic view showing that the shaft and the hand grip of the badminton racket of the present invention have been fastened together.

In the process of fastening the shaft 30 with the hand grip 40, the inner wall of the receiving hole 41 is first coated with an appropriate quantity of adhesive before the lower end of the shaft 30 is inserted into the receiving hole 41. As the shaft 30 is slowly inserted in the direction indicated by an arrow A as shown in FIG. 3 into the receiving hole 41, the air in the receiving hole 41 is forced out via the elongate through hole 43, as illustrated by an arrow 50 in FIG. 5. As a result, the coated adhesive of the receiving hole 41 will not be squeezed out through the upper end opening of the receiving hole 41. In other words, all the coated adhesive remains inside the receiving hole 41 so that the shaft 30 is adhered securely to the inner wall of the receiving hole 41 of the hand grip 40. The construction of the conical portion 42 is such that it becomes gradually smaller in dimension from the lower end thereof toward the upper end thereof, so as to ensure that the coated adhesive in the receiving hole 41 is prevented from being forced into the elongate through hole 43. The recessed strips 45 of the receiving hole 41 serve to enhance torsional strength of the shaft 30 and the hand grip 40. The hand grip 40 is provided at the lower end thereof with a cap 60.

The embodiment of the present invention described above is to be regarded in all respects as merely illustrative and not restrictive. Accordingly, the present invention may be embodied in other specific forms without deviating from the spirit thereof. The present invention is therefore to be limited only by the scope of the following appended claim.

What is claimed is:

1. An improved badminton racket comprising:

a head having a strung surface;

a shaft fastened at an upper end thereof with a lower end of said head;

a hand grip provided axially in an upper segment thereof with a receiving hole of an appropriate depth and dimensioned to receive therein a lower segment of said shaft, said receiving hole having a bottom wall on which a conical portion is disposed axially such that said conical portion is gradually smaller in dimension from a lower end thereof toward an upper end thereof, said hand grip further provided axially an elongate through hole extending from said upper end of said conical portion through a lower end wall of said hand grip, said receiving hole further provided axially on an inner wall thereof with a plurality of recessed strips spaced at a predetermined interval; and a cap dimensioned to fit securely over said lower end of said hand grip.

* * * * *